US005758458A

United States Patent [19]

Ridge

[11] Patent Number: 5,758,458

[45] Date of Patent: Jun. 2, 1998

[54] WOOD AND VINYL HYBRID RESIDENTIAL DOOR FRAME

[76] Inventor: Jimmy D. Ridge, 7210 Suits Rd., Archdale, N.C. 27263

[21] Appl. No.: 690,846

[22] Filed: Aug. 1, 1996

[51] Int. Cl.[6] ..... E06B 1/30

[52] U.S. Cl. ..... 52/204.1; 52/211; 52/212; 52/656.4; 49/504

[58] Field of Search ..... 49/504; 52/204.1, 52/211, 212, 656.4

[56] References Cited

U.S. PATENT DOCUMENTS

| | | | |
|---|---|---|---|
| 3,087,207 | 4/1963 | Styra . | |
| 3,591,985 | 7/1971 | Coppins . | |
| 3,774,345 | 11/1973 | Cole et al. . | |
| 4,430,830 | 2/1984 | Sailor | 49/504 X |
| 4,671,035 | 6/1987 | Ridge . | |
| 4,854,621 | 8/1989 | Baldwin | 49/504 X |
| 5,042,199 | 8/1991 | Schneider et al. | 49/DIG. 1 X |
| 5,058,323 | 10/1991 | Gerritsen . | |
| 5,182,880 | 2/1993 | Berge, Jr. et al. . | |
| 5,212,921 | 5/1993 | Unruh . | |
| 5,293,723 | 3/1994 | Slessor . | |
| 5,412,909 | 5/1995 | Wu | 52/212 X |

OTHER PUBLICATIONS

Brochure entitled "Weather-Wise Entry Door Systems"; Stanley (no date).

*Primary Examiner*—Christopher Kent
*Attorney, Agent, or Firm*—Rhodes, Coats & Bennett, L.L.P.

[57] ABSTRACT

A door frame assembly for use in framing residential entranceways. The door frame assembly includes a support panel, a base strip, and a stop strip. The support panel provides strength to the door frame assembly while the base and stop strips provide weather resistance and a desired appearance. The door frame assembly may also include a brick molding strip. An extension strip may be used to adapt the door frame assembly for use in framing a garage door. The door frame assembly may also be modified to form a mullion post for use in patio doors and the like.

40 Claims, 7 Drawing Sheets

WOOD AND VINYL HYBRID RESIDENTIAL DOOR FRAME

FIELD OF THE INVENTION

The present invention is directed to door frames for residential structures, and, more particularly, to a vinyl and wood hybrid residential door frame.

BACKGROUND OF THE INVENTION

It is, of course, of primary importance to protect any building or structure from the elements, and, in particular from water such as rain, snow, and high humidity. Many of the techniques employed for commercial structures are inappropriate for residential dwellings because of prohibitive cost or poor appearance. Thus, there has been and continues to be a trend in residential building to make such dwellings resistant to water, insects, rot, and ultra-violet radiation using techniques and components which are cost-effective and which convey a traditional residential appearance.

Recent Environmental Protection Agency mandates have resulted in treated wood and paint which are not as weather-resistant as in years past. Builders have sought alternatives to wood or supplementations to wood to provide more durable constructions. One technique for weatherproofing residences which has gained widespread acceptance is the cladding or covering of wood components of the residence with polyvinyl chloride (PVC) (hereinafter "vinyl"), aluminum, fiberglass or like materials. Vinyl is water-impermeable and highly resistant to sun and wind. Vinyl is used for siding to cover outer walls. Vinyl-clad, all-vinyl, and aluminum clad windows often replace traditional wood windows. Maintenance free prefinished steel garage and entrance doors are available. However, while several attempts have been made to provide a vinyl or vinyl-covered door frame, no suitable cost-effective constructions are presently available.

One attempt to provide a vinyl-covered door frame involves adhering a relatively thin (approximately 1/64-inch) flexible laminate to certain exposed wood portions of the door frame. This design suffers from several drawbacks. Laminated wood must be carefully handled because if the assembly is struck before or after installation (e.g., by a builder's wheelbarrow or by the resident), a more or less permanent dent is formed. The wood and adhesive may be affected by changes in temperature or humidity, or simply by age, so that the laminate becomes delaminated from portions of the wood.

Another attempt has been to "snap" relatively rigid vinyl or sheet metal aluminum covers onto wood door frame members, the vinyl covers having the same shape as the wood covers. This method overcomes some of problems associated with the vinyl laminate, but adds significantly to the expense of manufacturing, fabricating, and/or installing the door frame. Typically, the builder must cut the cladding to appropriate lengths and install on-site. Notably, none of the wood components are replaced by the vinyl, rather they are just covered by the vinyl or aluminum.

Recently, attempts have been made to design all-vinyl door frames. Such door frames suffer from several severe drawbacks and they have therefore not been accepted by the market. Foremost, all-vinyl door frames are very expensive as compared with conventional door frames. The all-vinyl construction does not have adequate strength. As a result, the frame is difficult to mount and may tend to deflect or sag due to lack of strength once installed. Further complicating installation is the inability of vinyl itself to properly hold a fastener such as a screw or nail. As a result, the all-vinyl door frame is difficult to mount and does not securely and durably hold various hardware such as strike plates or hinges. While attempts have been made to overcome these deficiencies (e.g., the insertion of metal strengthening members or fastening brackets into the vinyl construction), all such remedies add to the cost of the all-vinyl frames, which are already prohibitively expensive. Moreover, builders are reluctant to use such frames because they often require special installation techniques or tools.

Ideally, builders should be able to provide a residence which is substantially or entirely vinyl-clad (with the exception of the roof) at reasonable cost. Such capabilities presently exist, except that suitable door frames are not available. Thus, there exists a need for a vinyl-covered or protected door frame for residential structures. There exists a need for such a door frame which provides the benefits of wood door frames, and in particular the workabilities and structural characteristics thereof, while also providing the benefits of vinyl-clad door frames. More particularly, there exists a need for a door frame which may be installed by conventional methods and which is durable.

SUMMARY OF THE INVENTION

The present invention is directed generally to door frame assemblies, attachments, and components thereof which are particularly well suited for use in residential entranceways of various types. The door frame assemblies provide numerous advantages over door frames of the prior art including a desirable combination of strength and weather resistance, as well as cost effectiveness in manufacture and installation.

More particularly, the present invention is directed to a door frame assembly for framing a doorway, as follows. The door frame assembly includes a support panel having an interior end and an exterior end, and opposed inner and outer faces extending between the interior and exterior ends. A polymeric base strip is mounted on and substantially covers the exterior end of the support panel. A nailing fin extends outwardly from the base strip. A polymeric stop strip is mounted adjacent the inner face and has first and second ends. The first end is interfitted with the base strip. A stop face is formed on the second end.

The aforedescribed door frame assembly may be modified in various ways in accordance with the present invention. A portion of the inner face of the support panel adjacent the interior end is preferably exposed for mounting a hinge member directly thereto. The base strip may include a pair of spaced apart opposed side fins defining a U-shaped channel, each of the side fins being secured to and disposed adjacent a respective one of the inner and outer faces of the support panel. The base strip may include a decorative body portion extending outwardly from the exterior end of the support panel. Moreover, the base strip may include a connector tube formed therein for receiving a key whereby the door frame assembly may be joined to another door frame assembly to form a door frame system. Preferably, the base strip includes a J-shaped channel extending therefrom. The first end of the stop strip is interlocked with the J-shaped channel. The stop strip may include a weatherstrip channel formed in the second end adjacent the stop face. The weatherstrip channel is arranged and configured to receive and hold a weatherstrip.

Where it is desired to frame a garage door, the door frame assembly may further include an extension strip disposed adjacent the inner face of the support panel and having a first end and a second end. The first end of the extension strip is interfitted with the second end of the stop strip. The extension strip includes a wall spaced from the inner face and defining therewith an opening adjacent the second end of the extension strip for receiving a garage door combination stop and weather strip molding.

The door frame assembly as described above may further include a brick molding strip having a first end and a second end. The first end is attached to the base strip. The brick molding strip may further include a brick molding nailing fin extending from the second end of the brick molding strip for securing the brick molding strip to a wall. Preferably, the brick molding strip substantially covers the nailing fin of the base strip.

The present invention is further directed to a door frame kit for use with a support panel of the type having an interior end, an exterior end and opposed inner and outer faces extending between the interior and exterior ends. The door frame kit includes a polymeric base strip mounted on and substantially covering the exterior end when secured thereto. A nailing fin extends outwardly from the base strip. A polymeric stop strip, when assembled, is mounted adjacent the inner face. The stop strip has first and second ends. The first end is intermitted with the base strip. A stop face is formed on the second end. The door frame kit may further be modified and provided with the features as discussed above with regard to the door frame assembly of the present invention.

The present invention is further directed to a door frame assembly as follows. The door frame assembly includes a support panel having an interior end and an exterior end and opposed inner and outer faces extending between the interior and exterior ends. The inner face of the support panel is substantially planar. A polymeric base strip is mounted on and covers the exterior end. A polymeric stop strip is mounted adjacent the inner face and has first and second ends. The first end is intermitted with the base strip. A stop face is formed on the second end and extends outwardly from the inner face.

The door frame assembly as just described may be modified and provided with the features as discussed above with regard to the first described door frame assembly. Moreover, the base strip may include a base strip nailing fin with the brick molding strip substantially covering the base strip nailing fin.

The present invention is further directed to a brick molding strip for use in a door frame assembly to be mounted in a wall. The brick molding strip includes a nailing fin extending along an edge thereof for receiving a fastener for securing the brick molding strip to the wall.

The present invention is also directed to a stop strip for use with a base strip of the type having a connecting structure and a support panel having an inner face. The stop strip has first and second ends. The stop strip includes a second connecting structure formed in the first end for connecting said stop strip to the base strip connecting structure. A body portion extends between the first and second ends. The body portion is spaced apart from the inner face of the support panel when the stop strip is mounted on the support panel. A stop face is formed in the second end of the stop strip. Further, a weatherstrip channel is formed in the stop face. The weatherstrip channel is arranged and configured to receive and hold a weatherstrip.

Preferably, the second connecting structure of the stop strip includes a groove extending transversely to the length of the body portion. The stop strip may further include a brace fin extending from the body portion toward the inner face of the support panel when the stop strip is mounted on the support panel. The brace fin is operative to limit deflection of the body portion toward the inner face. A fastener fin may extend from the second end. The fastener fin is operative to receive a fastener for securing the stop strip to the inner face of the support panel.

Additionally, the present invention is directed to a mullion post assembly. The mullion post assembly includes a support post having first and second ends and a side face extending between the first and second ends. A groove is formed in the first end. A base strip is provided including first and second spaced apart opposed side fins. The first side fin is disposed in the groove and the second side fin is positioned adjacent the side fin. A stop strip having a stop face is mounted on the base strip adjacent the side face of the support post.

Preferably, the base strip defines a channel and the stop strip is disposed in the channel. A weather strip may be secured between the stop strip and the second side fin.

Where desired, the support post of the mullion post may include a second side face opposite the first side face with the mullion post assembly including a pair of the base strips. The first side fins of the respective base strips are each disposed in the groove. Preferably, the mullion post assembly further includes a connector strip interconnecting the pair of base strips.

The present invention is further directed to a combined door frame and window frame system including a door frame assembly and a window frame assembly. The door frame assembly includes a first support panel having an exterior end, and a first base strip mounted on and substantially covering the exterior end of the first support panel. The window frame assembly is disposed adjacent the door frame assembly. The window frame assembly includes a second support panel having an exterior end, and a second base strip mounted on and substantially covering the exterior end of the second support panel. A connector strip joins the first and second base strips to one another.

An object of the present invention is to provide a door frame for residential structures.

Another object of the present invention is to provide a door frame which is weather-resistant, and in particular, which is water-resistant.

An object of the present invention is to provide a vinyl-clad door frame which is durable.

A further object of the present invention is to provide a door frame which may be installed by conventional methods.

Moreover, an object of the present invention is to provide such a door frame which may be cost-effectively manufactured.

A further object of the present invention is to provide a door frame as described above which is versatile so that it may be used with different wall thicknesses.

Yet another object of the present invention is to provide a door frame as described above which may be used for a variety of door openings in a dwelling. Moreover, an object of the present invention is to provide such a door frame assembly which can be used for a variety of door frames with accompanying attached overhead windows and sidelights of similar construction.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 3:
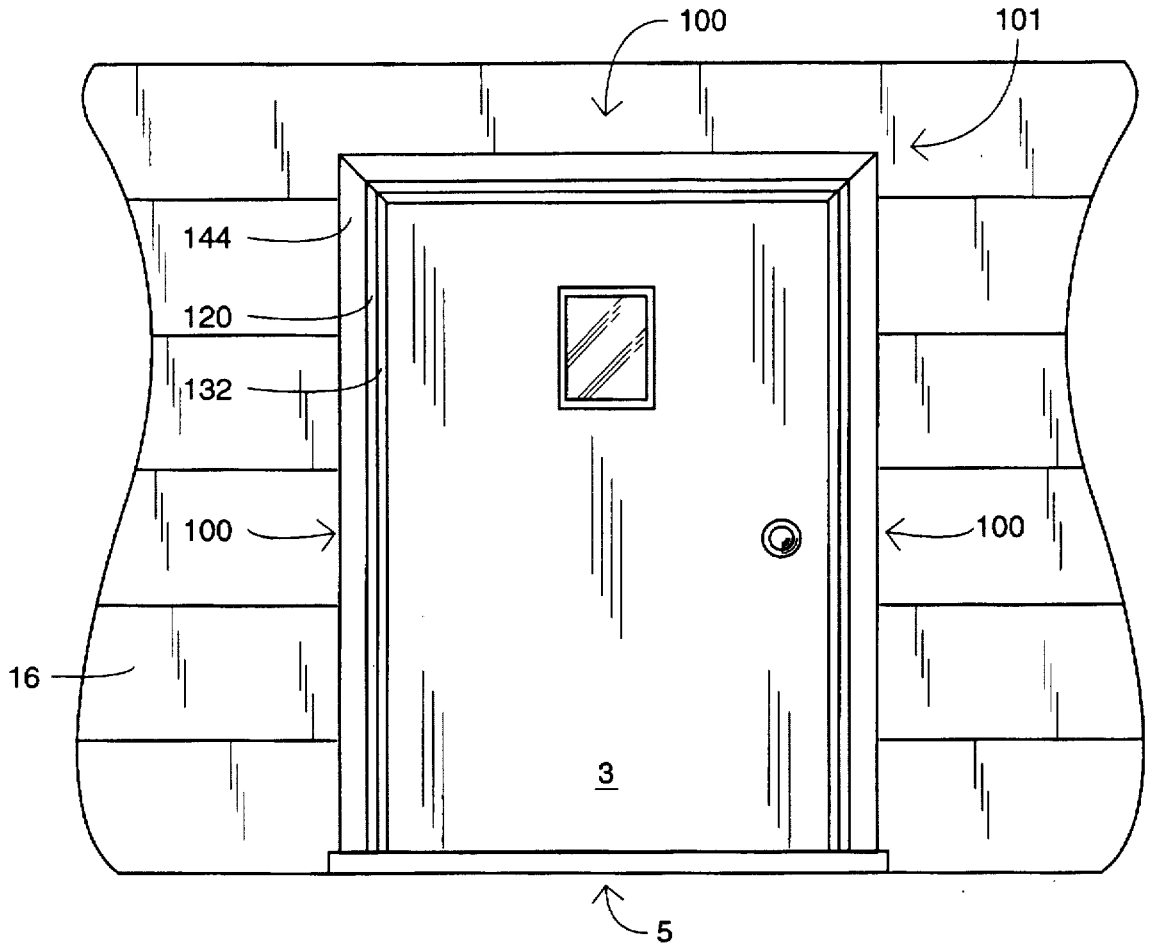
FIG. 3 is a fragmentary, plan view of a doorway including a door system incorporating door frame assemblies according to the first embodiment.

With reference to the figures, door frame assemblies 100, 200, 300 according to three embodiments of the present invention are shown therein. Door frame assemblies 100, 200, 300 are each adapted for use in constructing doorjambs for different door types of a residence. Door frame assembly 100 is configured to construct conventional hinged entrance doorjambs, for example as shown in FIG. 3. Door frame assembly 200 is adapted for framing a sectional vertical garage door. Door frame assembly 300 is suitable for use as a center jamb or mullion post for multiple panel doors, patio doors or the like. The door assemblies share common components and are adaptable for use in constructing doorjambs of different standard depths. In this way, a door framing system is provided which may be selectively configured for framing essentially every type of conventional door of a residence. Moreover, each of the door assemblies includes vinyl components and a wood component in such a manner as to beneficially utilize the properties of each material in complementary fashion.

Turning to door frame assembly 100 in greater detail, a conventional doorway 5 incorporating door frame assembly 100 is shown in FIG. 3. A pair of vertically-disposed door frame assemblies 100 and an overlying horizontally-disposed door frame assembly 100 define a door frame system 101 in which door 3 is hingedly-mounted. As seen from the exterior of the residence, door frame assembly 100 includes brick molding 144.

Figure 1:
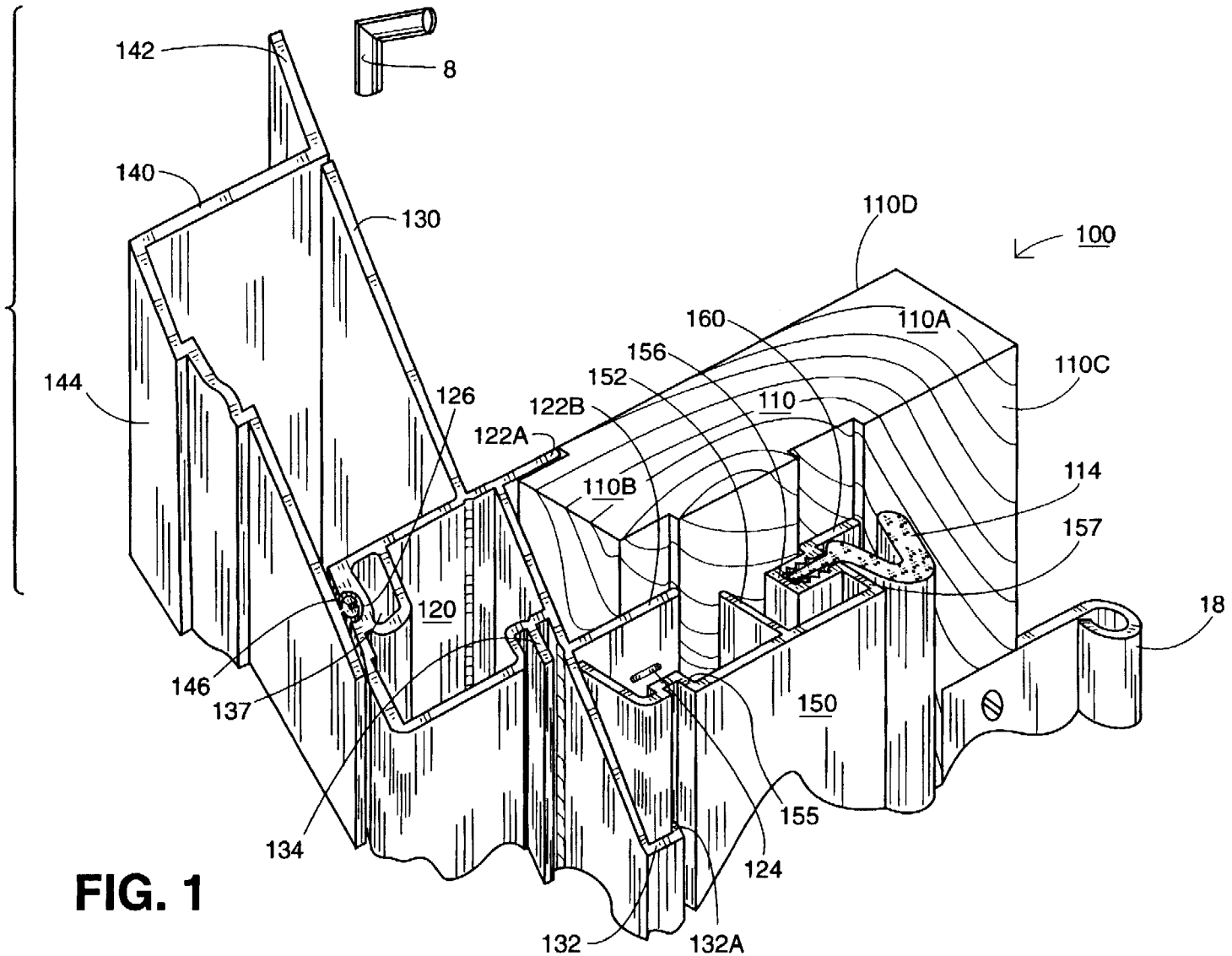
FIG. 1 is a fragmentary, perspective view of a door frame assembly according to a first embodiment of the present invention.
Figure 2:
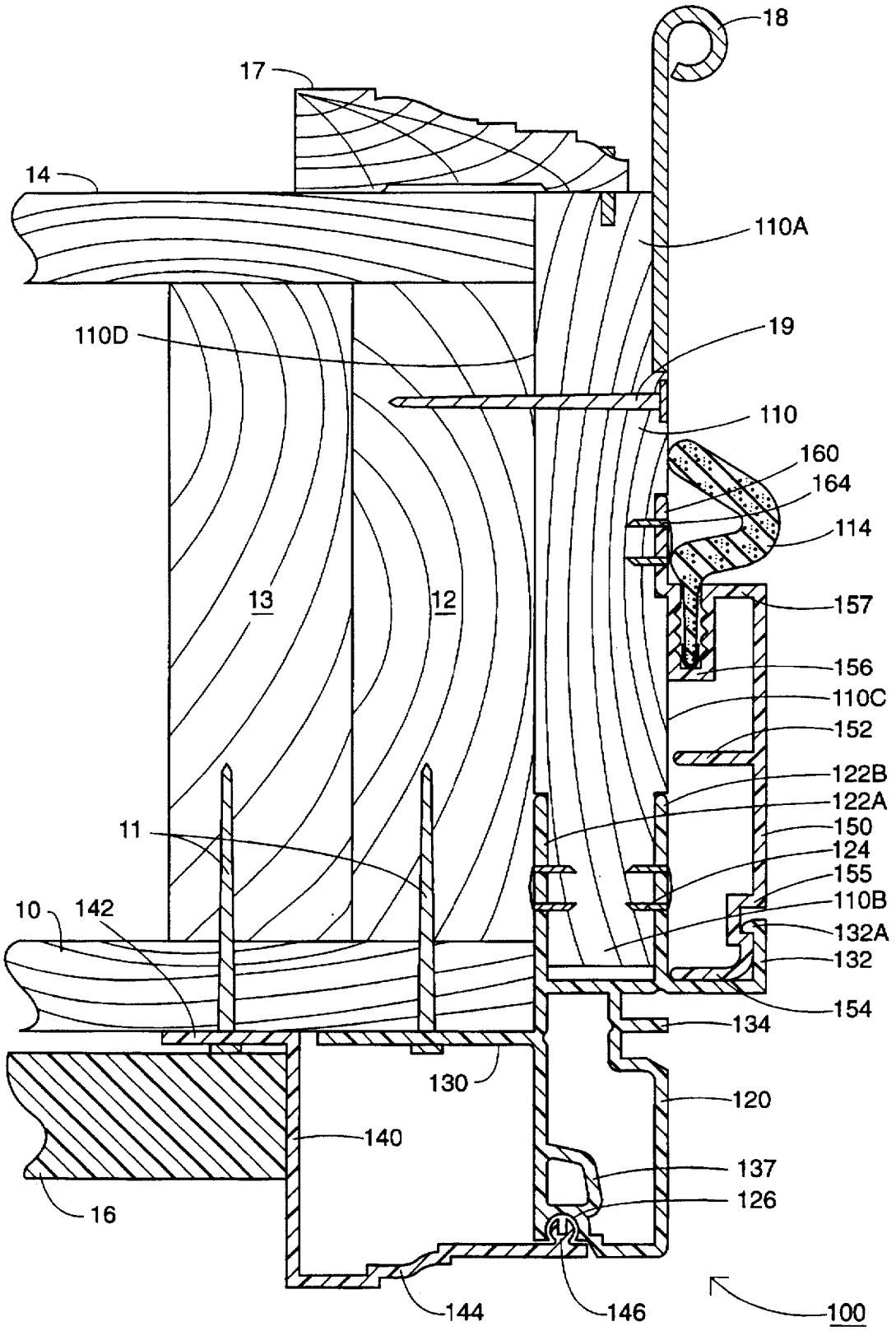
FIG. 2 is a fragmentary, cross-sectional view of FIG. 1 mounted in a door opening.

The construction and installation of door frame assembly 100 will be more fully appreciated with reference to FIGS. 1 and 2. Door frame assembly 100 includes wood panel 110 in conjunction with vinyl extrusions 120, 150. Wood panel 110 has a prescribed width (as discussed below), a conventional thickness (typically about 11/16 inch), and a length extending the height of the intended doorway. Width-wise, wood panel 110 has an interior end 110A (i.e., the end positioned adjacent the interior of the residence), an exterior end 110B (i.e., the end positioned adjacent the exterior of the residence), an inner face 110C (i.e., with respect to the doorway opening), and an outer face 110D. Conventional hinge member 18 is secured by screws or other conventional means directly to the inner face 110C of wood panel 110 adjacent interior end 110A. Casing 17 is secured to interior end 110A of the wood panel by any suitable adhesive or fasteners.

Exterior extruded strip 120 (hereinafter "first extrusion") is mounted on exterior end 110B of wood panel 110. More particularly, outer side fin 122A and inner side fin 122B abut opposite sides of wood panel 110 and are secured thereto by staples 124 or other suitable means such as brads, nails or adhesive. Preferably, wood panel 110 is provided with recesses or grooves as shown to receive fins 122A, 122B. Fins 122A and 122B are preferably spaced apart such that they fit flush against the respective faces of the wood panel in the recesses. The body of first extrusion 120 extends outwardly from end 110B and has longitudinal stabilizer/decorative fin 134 and stabilizer/corner connecting tube 137 formed therein. Circular slot 126 is formed in first extrusion 120 as well and communicates with the front face of the extrusion as shown. Nailing fin 130 extends outwardly from the outer (i.e., with respect to the doorway opening) face of first extrusion 120. Connector channel 132 extends outwardly from the inner face of first extrusion 120 and terminates in lip 132A.

Brick molding extrusion 140 is mounted on first extrusion 120 by connector bead 146 which fits within slot 126. Front face 144 overlies nailing fin 130 and is shaped and colored so as to simulate painted wood brick molding without exposed nail holes. Nailing fin 142 extends outwardly from molding 140.

Extruded stop strip 150 (hereinafter "second extrusion") is mounted to first extrusion 120 and wood panel 110 along the inner surface 110C of the wood panel. Connector end 154 is sized and shaped to interlock with connector channel 132. More particularly lip 132A is disposed in channel 155. Staple 164 secures fin 160 to the wood panel. Preferably, wood panel 110 is provided with a recess or groove as shown to receive fin 160. Brace fin 152 extends inwardly from second extrusion 150 to prevent the midsection of the extrusion from bending inwardly toward the wood panel. Weatherstrip channel 156 holds conventional weatherstrip 114 in place by interference fit. The interior surface of channel 156 may include ridges thereon to better grip the weatherstrip. Stop face 157 is disposed adjacent weatherstrip 114 and at a right angle to the width of wood panel 110 such that a door face bearing against weatherstrip 114 will be braced by stop face 157.

First extrusion 120, second extrusion 150, and brick molding 140 are preferably formed from extruded polyvinyl chloride (PVC) or like material. Suitable extrusion processes are well known to those of ordinary skill in the art. The grooves for receiving fins 122A, 122B, 160 may be formed in wood panel 110 by any suitable methods. Door frame assembly 100 is assembled by sliding fins 122A, 122B of first extrusion 120 over exterior end 110B of wood panel 110 and inserting staples 124. Connector end 154 of second extrusion 150 is snap-fit into connector channel 132. Fin 160 is thereafter stapled to the inner face of wood panel 110. Weatherstripping 114 is inserted into weatherstripping channel 156 before or after mounting second extrusion 150. A strike plate (not shown) and brick molding 140 are preferably not mounted to door frame assembly 100 until after door frame assembly 100 is mounted in the doorway, as discussed below. Hinge 18 is preferably mounted prior to installation of the door frame assembly into the doorway. The door is preferably pre-installed as well.

With reference to FIG. 2, a framed door opening typically consists of a wood studs or posts 12, 13, a layer of sheathing 10 along an exterior end of the stud, and a layer of SHEETROCK™ 14 along an interior end of the stud. Preferably, door frame system 101 is pre-fabricated as an assembled frame with the hinges 18 mounted on wood panel 110 by suitable fasteners and the door mounted on the hinges. Each of the header and side door frame assemblies are mounted in the following manner. Each door frame assembly 100 is mounted in the rough door opening by a nail 19 or other suitable fastener. It will be appreciated that wood panel 110 is thereby mounted in the doorway by the same method and technique as used for conventional all-wood door frames so that no special technique or tools are required. Nail fin 130 is secured to sheathing 10 by nail 11 or any other suitable fastener. If desired, interior casing 17 may be mounted to interior end 110A of wood panel 110 by suitable fasteners.

Preferably, extrusions 120 and brick moldings 140 are miter cut as shown in FIG. 1 so that the respective extrusions 120 and brick moldings 140 of the vertical side door frame assemblies interface with the adjacent ends of the extrusion 120 and brick molding 140 of the header at complementary angles (preferably 45° each) as shown in FIG. 3. FIG. 1 shows the end of a vertical door frame assembly 100. The header door frame assembly is similarly configured, except that the upper end of the wood panel is positioned flush with the upper edge of fin 122B and the upper end of second extrusion 150 is flush with the upper edge of channel 132. The adjacent ends of the vertical and header door frame assemblies are held together and aligned by L-shaped keys 8 (see FIG. 1), each of which has one leg inserted within the joint tube 137 of a vertical door frame assembly and the other leg inserted within the joint tube 137 of the header. A significant advantage is provided in the manufacture of door frame assemblies 100 in that only extrusions 120, 140 need to be miter cut to attain the overall door frame appearance, aesthetically appealing joinder and construction shown. The wood panels 110 and extruded stop strips 150 are preferably square cut. Because the lengths of the mitered edges to be mated (i.e., extending the depth of the doorway) are substantially shortened, it is much easier to obtain a satisfactory joinder. Moreover, conventional structural joining techniques may be employed.

The use of brick molding 140 is optional. If brick molding 140 is not used, brick veneer or siding 16 is applied over nailing fin 130 in conventional fashion such that it and the attaching nails are covered by the brick or siding. If brick molding 140 is desired, it is mounted to door frame 100 by sliding or snapping connector bead 146 into connector slot 126 and securing fin 142 to sheathing 10 and stud 13 by a nail 11 or other suitable fastener. The brick or siding is applied over fin 142 rather than fin 130. Notably, fin 130 will be covered by brick molding 140.

A primary advantage of door frame assembly 100 is that extrusions 120, 140 may be used for doorways of any depth. It is only necessary to vary the width of extrusion 150 to properly position stop face 157 and weatherstrip 114 for doorways of different depths. For example, in regions of the United States having more temperate climates, stud 12 is typically a 2"×4" stud and the overall wall thickness is 4 and 9/16 inches. In cooler regions, it is common to use 2"×6" studs instead, resulting in a wall thickness, and thus a doorway depth, which is about two (2) inches greater (i.e., 6 and 9/16 inches). The door frame assembly of the present invention can accommodate an infinite variety of wall thicknesses simply by using a second extrusion 150 and wood panel 110 of appropriate widths. This provides an advantage in manufacturing in that tooling and inventory costs are reduced. An advantage is provided to the builder in that reduced inventory is needed.

Another advantage is provided in that door frame assembly 100 is modular. As a result, door frame assembly is as convenient or more convenient to install than traditional all-wood door frames. Hinged doors may be hung and aligned in conventional manner. All securements are as strong and durable as in the case of all-wood door frames. Moreover, the wood panel gives the rigidity of wood while the extrusions give the protection and advantages of vinyl (e.g., no need to paint, impact resistant).

Figure 4:
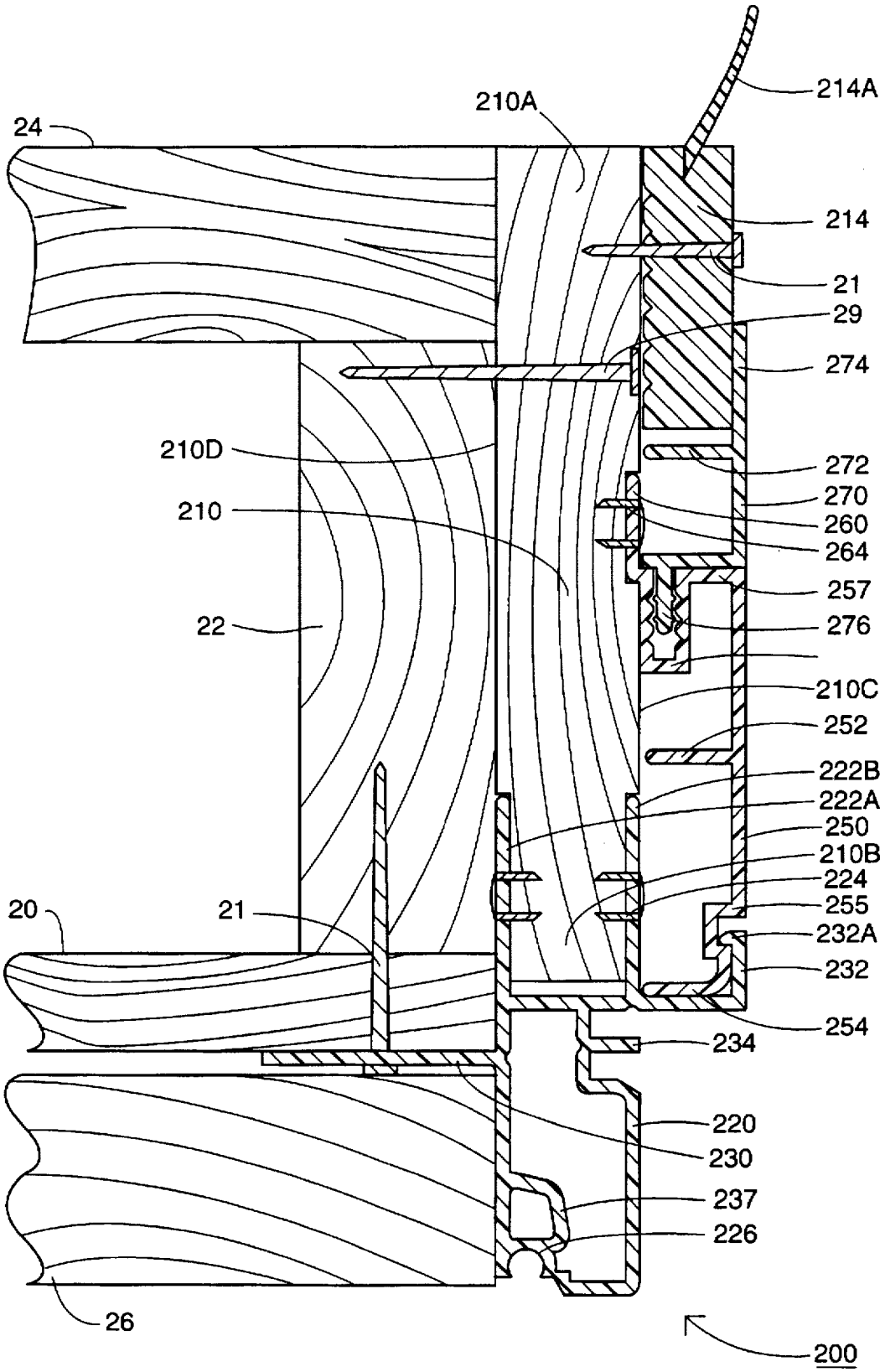
FIG. 4 is a fragmentary, cross-sectional view of a door frame assembly according to a second embodiment mounted in a door opening, the door frame assembly adapted for use in framing a garage door.

Turning to FIG. 4, door frame assembly 200 according to a second embodiment of the present invention is shown therein in cross section and mounted in a conventional garage door opening. Wood panel 210 has inner face 210C, outer face 210D, interior end 210A and exterior end 210B, and is typically longer than wood panel 110 of the first embodiment to accommodate the additional depth of the garage door opening as compared to the conventional swinging door opening. Elements 220, 222A, 222B, 224, 226, 230, 232, 232A, 234, 237, 250, 252, 254, 255, 256, 257, and 260 of door frame assembly 200 correspond to elements 120, 122A, 122B, 124, 126, 130, 132, 132A, 134, 137, 150, 152, 154, 155, 156, 157, and 160 of door frame assembly 100.

Door frame assembly 200 also includes extruded extension strip 270 (hereinafter "third extrusion"). Third extrusion 270 is secured to door frame assembly 200 by connector fin 276 which fits within channel 256 of second extrusion 250. Connector fin 276 is preferably provided with vertical ridges to supplement an interference fit. End fin 274, brace fin 272, and the inner surface 210C of wood panel 210, together form a channel for receiving garage door weather molding 214. Molding 214 is typically provided in garage door installation kits and has flap or weather strip 214A which, in use, lies against the front face of the garage door. Door frame assembly 200 may be assembled in the same manner as set forth above with regard to door frame assembly 100 except that third extrusion 270 is inserted into channel 256 in place of weatherstrip 114.

As noted above, the garage door opening is typically deeper than a conventional residential hinged-door entrance. The wall at the door opening typically includes sheathing 20, wood post 22, and interior wall post 24 which is typically much thicker than the SHEETROCK™ or various other wall panels adjacent a hinged entrance door. To frame a garage door, door frame assembly 200 is mounted to post 22 by a nail or other suitable fastener 29. Nailing fin 230 is likewise secured to sheathing 20 by a fastener 21. Molding 214 is slid between end fin 274 and the inner surface 210C of wood panel 210, and is thereafter secured in place by a nail or other suitable fastener 21. Notably, molding may be adjusted to properly fit the depth of the doorway or the position of the door by sliding the molding more or less deeply between fin 274 and the wood panel. Nailing fin 230 and the inserted fastener 21 are ultimately covered by siding 26.

From the foregoing, it will be appreciated that the first and second extrusions of door frame assembly 100 of the first embodiment may be adapted to frame a garage door simply by modifying the length of wood panel 220 and using an additional third extension extrusion. Moreover, door frame assembly 200 requires no special techniques or tools for installing and provides both the strength and weather-resistance desired.

Figure 5:
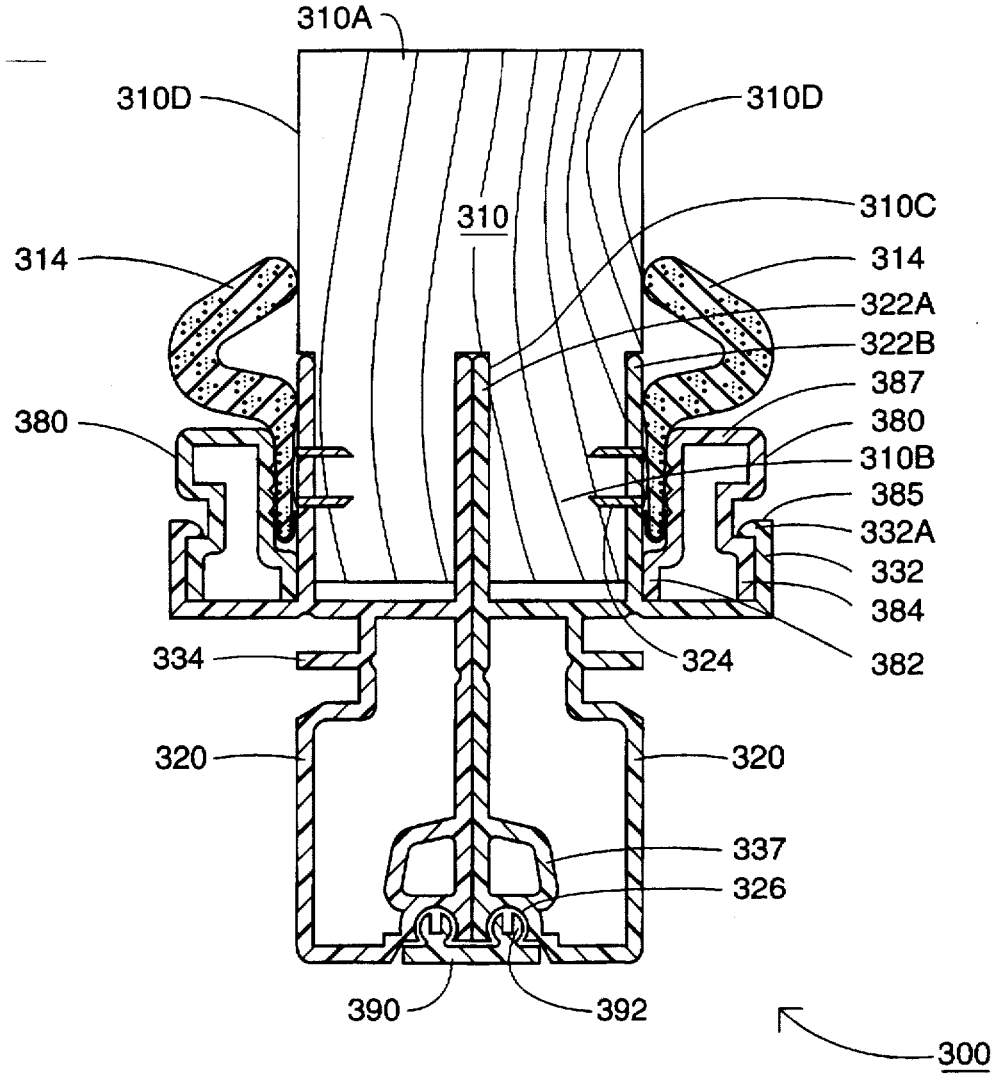
FIG. 5 a cross-sectional view of a mullion post according to a third embodiment of the present invention.
Figure 6:
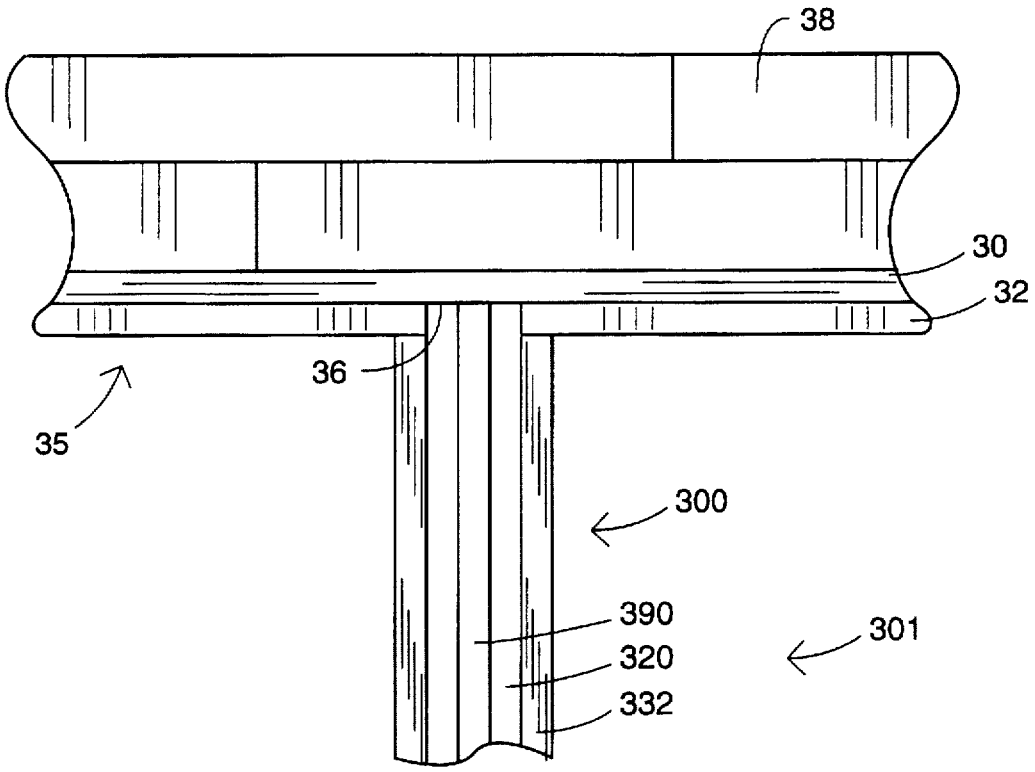
FIG. 6 is a fragmentary, plan view of a doorway incorporating the mullion post of FIG. 5.

The present invention may also be adapted for use in forming a mullion post 300 as shown in FIGS. 5 and 6. In some popular patio door configurations, a pair of doors or a door and a stationary glass panel are separated by a mullion post. Mullion post 300 as shown is adapted for two doors, however, it will be appreciated that it may be modified for use in a configuration having a door on one side and a stationary glass panel on the other.

Mullion post 300 includes wood post 310 having interior end 310A, exterior end 310B, and side faces 310D. Lengthwise groove 310C is formed in exterior end 310B. First extrusions 320 are mounted on either side of wood post 310. First extrusions 320 correspond to extrusions 120 and 220 except that no nailing fin corresponding to elements 130, 230 is present. In particular, first extrusions 320 each include elements 322A, 322B, 324, 326, 332A, 334, and 337 corresponding to elements 122A, 122B, 124, 126, 132A, 134, and 137, respectively. Side fins 322A are disposed in groove 310C which is preferably sized and shaped to provide an interference fit with the side fins 322A. Side fins 322B are secured to the side faces 310D of wood post 310 by staples 324 or other suitable fasteners. The relative alignment and continuity of appearance of the side-by-side first extrusions 320 are ensured by mullion strip 390 which has parallel connector beads 392 which are slid or snap fit into the respective connector slots 326.

An extruded stop strip 380 is position in each respective connector channel 332. More particularly, each stop strip 380 is held in place by resilient legs 382, 384 which bear against side fin 322B and channel 332, and thereby maintain lip 322A in channel 385. Weatherstripping 314 is held between side fin 322B and leg 382 by interference fit. Stop face 387 serves to brace weatherstripping 314 against the door when in use.

Mullion post 300 may be assembled by inserting fins 322A and 322B of first extrusions 320 into and about wood post 310 and inserting fasteners 324. Beads 392 of mullion strip 390 are slid or snapped into slots 326. Stop strips 380 are snap fit into connector channels 332. Weatherstrips 314 are wedged between stop strips 380 and side fins 322B.

FIG. 6 shows an exemplary door frame system 301 incorporating mullion post 300. Header 35 includes an extrusion 30 corresponding to first extrusion 120 of the first embodiment secured to a wood panel (not shown) corresponding to wood panel 110, and a second extrusion (not shown) corresponding to second extrusion 150. Extrusion 30 has element 32 corresponding to element 132. Recess 36 is formed in channel 32 to receive a portion of the upper end of mullion post 300. Stop strips 380 and channels 332 abut the undersurface of the second extrusion of the header, while post 310 and the remainder of first extrusions 320 abut the undersurface of the wood panel of the header and the fin (not shown) of the header first extrusion 30, respectively. Siding 38, for example, covers the nailing fin (not shown) of extrusion 30.

Mullion post 300 provides the strength and rigidity of wood post 310 with the weather-resistance of the vinyl extrusions. Extrusion 320 may be the same as the first extrusions of the first and second embodiments except that it is formed without the nailing fin or the nailing fin is removed. As in the first and second embodiments, the mullion post may be efficiently assembled and installed and does not require special tools or techniques for installation.

Figure 7:
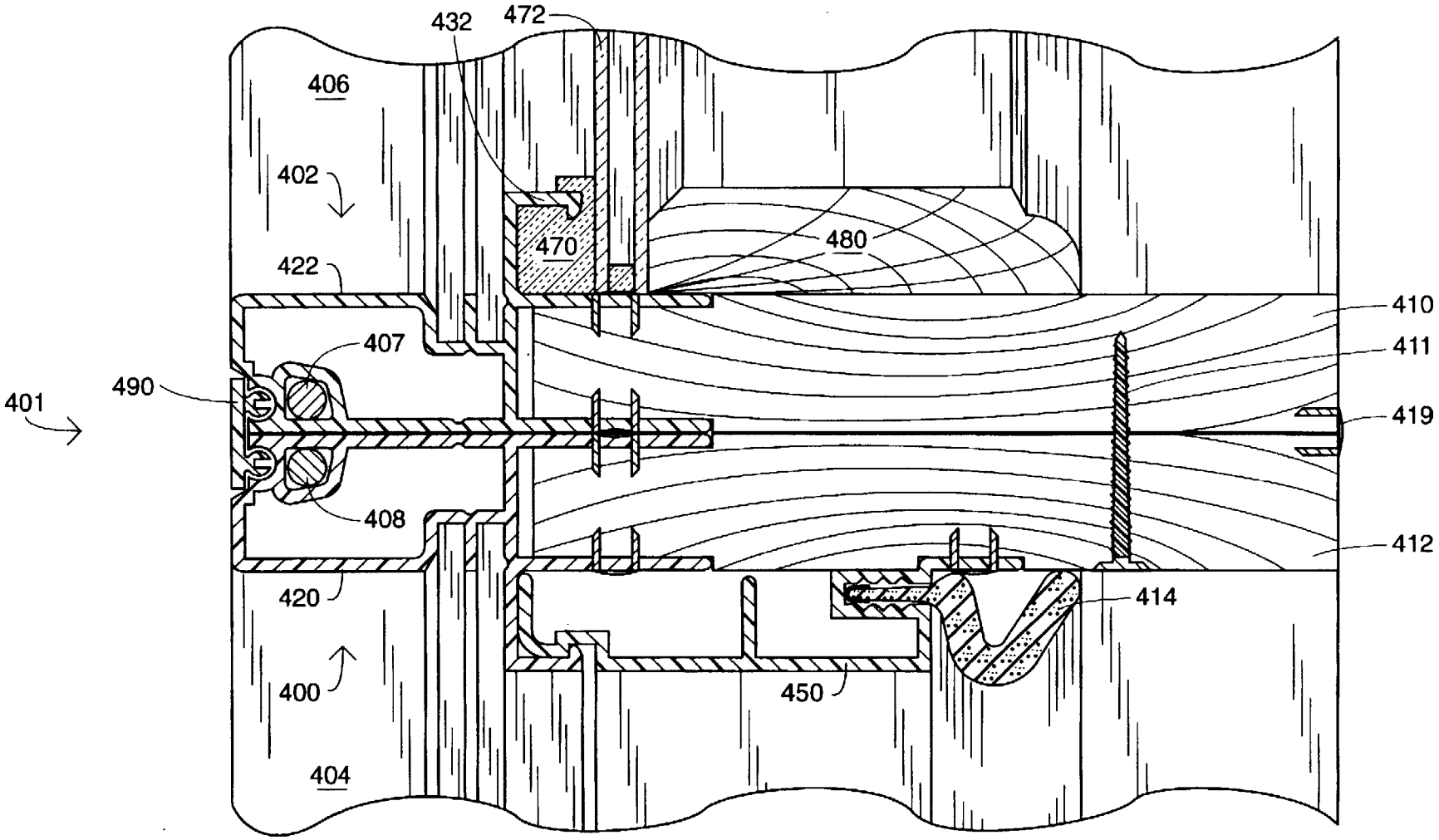
FIG. 7 a fragmentary, cross-sectional view of a door frame system according to the present invention including an attached overhead window.

The door frame assembly according to the present invention may be used to construct door frame systems including an attached overhead window or sidelight. With reference to FIG. 7, a door frame system is shown therein in fragmentary and cross section. The embodiment will be discussed as a residential entrance door frame having an overhead window, the cross section being taken vertically through the header and a portion of the overhead window. However, it will be appreciated that substantially the same construction would be employed with a sidelight, the cross section being taken horizontally through a vertical door jamb and a portion of the sidelight window.

As shown, door frame system 401 includes vertical door frame assembly 404, a second vertical door frame assembly opposite assembly 404 (not shown), horizontal door frame assembly 400, horizontal window frame assembly 402, and vertical window frame assembly 406. Vertical door frame assembly 404 and the other vertical door frame assembly each correspond to door frame assembly 100 of the first embodiment and may include a brick molding (now shown).

Horizontal door frame assembly 400 includes wood panel 412 corresponding to wood panel 110, first extrusion 420 corresponding to first extrusion 320, and second extrusion 450 corresponding to second extrusion 150 and having weather strip 414 seated therein. Horizontal door frame assembly 400 is joined end to end with door frame assembly 404 and the other vertical door frame assembly by keys 408 (only one shown).

Window frame assembly 402 includes first extrusion 422 corresponding to first extrusion 420, and wood panel 410 corresponding to wood panel 110. Wood panel 412 is joined to wood panel 410 by screw 411 and corrugated fastener 419 or other suitable means.

The exterior ends of first extrusions 420 and 422 of door frame assembly 400 and window frame assembly 402 are joined by mullion strip 490 corresponding to mullion strip 390 of mullion post 300. Vertical window frame assembly 406 corresponds to window frame assembly 402 except that it may be straight (e.g., to form a rectangular window) or curved (e.g., to form a semi-circular window). Window frame assemblies 402, 406 are joined by key 407. Insulated glass unit 472 is positioned against channel 432 and sealed with caulk 470. Insulated glass unit 472 is held in place by molding 480, preferably formed of wood.

While a preferred embodiment of the present invention has been described, it will be appreciated by those of ordinary skill in the art that certain modifications may be made without departing from the scope of the present invention. All such modifications are intended to come within the scope of the claims which follow.

What is claimed is:

1. A door frame assembly attachable to a stud or post adjacent a door frame opening for framing a doorway, said door frame assembly comprising:

a. a support panel attachable to said stud and having an interior end and an exterior end and opposed inner and outer faces extending between said interior and exterior ends;

b. a polymeric base strip attached to and substantially covering said exterior end of said support panel;

c. a nailing fin extending outwardly from said base strip for attaching said base strip to said stud;

d. a polymeric stop strip mounted adjacent said inner face and having first and second ends, said first end interfitted with said base strip, and said second end attached to said support panel and having a stop face formed thereon; and e. wherein said base strip and said stop strip are separately formed, distinct pieces.

2. The door frame assembly of claim 1 wherein a portion of said inner face of said support panel adjacent said interior end is exposed for mounting a hinge member directly thereto.

3. The door frame assembly of claim 1 wherein said base strip includes a decorative body portion extending forwardly from said exterior end of said support panel in a direction defined along the line between said interior and exterior ends of said support panel and a pair of spaced apart opposed side fins integrally formed with and extending from said body portion, said body portion and said side fins together defining a U-shaped channel, each of said side fins being secured to and disposed adjacent a respective one of said inner and outer faces of said support panel.

4. The door frame assembly of claim 1 wherein said base strip includes a connector tube formed therein sized and configured to receive a key whereby said door frame assembly may be joined to another door frame assembly to form a door frame system, said connector tube in cross-section being fully enclosed.

5. The door frame assembly of claim 1 wherein said base strip includes a J-shaped channel extending therefrom, said first end of said stop strip interlocked with said J-shaped channel.

6. The door frame assembly of claim 1 wherein said stop strip includes a weatherstrip channel formed in said second end adjacent said stop face, said weatherstrip channel arranged and configured to receive and hold a weatherstrip.

7. The door frame assembly of claim 1 further including an extension strip disposed adjacent said inner face of said support panel and having a first end and a second end, said first end of said extension strip interfitted with said second end of said stop strip, said extension strip including a wall spaced from said inner face and defining therewith an opening adjacent said second end of said extension strip for receiving a garage door molding.

8. The door frame assembly of claim 1 further including a brick molding strip having a first end and a second end, said first end attached to said base strip.

9. The door frame assembly of claim 8 wherein said brick molding strip further includes a brick molding nailing fin extending from said second end of said brick molding strip for securing said brick molding strip to a wall.

10. The door frame assembly of claim 8 wherein said brick molding strip substantially covers said nailing fin of said base strip.

11. The door frame assembly of claim 1 wherein said stop strip includes a body portion having a length extending between said first and second ends of said stop strip and further including a brace fin extending from and transversely to said length of said body portion and positioned between said first and second ends such that said brace fin extends toward said inner face of said support panel, said brace fin operative to limit deflection of said body portion toward said inner face.

12. The door frame assembly of claim 1 further including a fastener fin extending rearwardly from said stop face and operative to receive a fastener for securing said stop strip to said inner face of said support panel such that the fastener extends through said fastener fin and into said inner face of said support panel.

13. A door frame kit for use with a support panel of the type having an interior end, an exterior end and opposed inner and outer faces extending between the interior and exterior ends, in which said support panel is attachable to a stud or post adjacent the door frame opening, said door frame kit comprising:

a. a polymeric base strip for mounting on and substantially covering said exterior end of said support panel when secured thereto;

b. a nailing fin integrally formed with and extending outwardly from said base strip for attaching said base strip to said stud;

c. a polymeric stop strip, when assembled, mounted adjacent said inner face and having first and second ends, said first end interfitted with said base strip, said second end attachable to said support panel and having a stop face formed thereon; and d. wherein said base strip and said stop strip are separately formed, distinct pieces.

14. The door frame kit of claim 13 wherein, when said door frame kit is mounted on the support panel, a portion of the inner face of the support panel adjacent the interior end is exposed for mounting a hinge member directly thereto.

15. The door frame kit of claim 13 wherein said base strip includes a decorative body portion and a pair of spaced apart opposed side fins integrally formed with and extending from said body portion, said body portion and said side fins together defining a U-shaped channel, said U-shaped channel arranged and configured such that, when said base strip is mounted on the support panel, each of said side fins are secured to and disposed adjacent a respective one of the inner and outer faces of the support panel and said body portion extends forwardly of the support panel in a direction defined along the line between the interior and exterior ends.

16. The door frame kit of claim 13 wherein said base strip includes a connector tube formed therein sized and configured to receive a key whereby said base strip may be joined to another base strip said connector tube in cross-section being fully enclosed.

17. The door frame kit of claim 13 wherein said base strip includes a J-shaped channel extending therefrom, said first end of said stop strip interlockable with said J-shaped channel.

18. The door frame kit of claim 13 wherein said stop strip includes a weatherstrip channel formed in said second end adjacent said stop face, said weatherstrip channel arranged and configured to receive and hold a weatherstrip.

19. The door frame kit of claim 13 further including an extension strip positionable adjacent the inner face of the support panel and having a first end and a second end, said first end of said extension strip interfittable with said second end of said stop strip, said extension strip including a wall spaced from the inner face when said extension strip is mounted thereon so as to define an opening adjacent said second end of said extension strip for receiving a garage door molding.

20. The door frame kit of claim 13 further including a brick molding strip having a first end and a second end, said first end attachable to said base strip.

21. The door frame kit of claim 20 wherein said brick molding strip further includes a brick molding nailing fin extending from said second end of said brick molding strip for securing said brick molding strip to a wall.

22. The door frame kit of claim 20 wherein said brick molding strip substantially covers said nailing fin of said base strip when assembled.

23. The door frame kit of claim 13 further wherein said stop strip includes a body portion having a length extending between said first and second ends of said stop strip and including a brace fin extending from and transversely to said length of said body portion and positioned between said first and second ends such that said brace fin extends toward the inner face of the support panel when said stop strip is mounted on the support panel, said brace fin operative to limit deflection of said body portion toward the inner face.

24. The door frame kit of claim 13 further including a fastener fin extending rearwardly from said stop face and operative to receive a fastener for securing said stop strip to the inner face of the support panel such that the fastener extends through said fastener fin and into the inner face of the support panel.

25. A door frame assembly attachable to a stud or post adjacent a door frame opening comprising:

a. a support panel attachable to said stud and having an interior end and an exterior end and opposed inner and outer faces extending between said interior and exterior ends, said inner face being substantially planar;

b. a polymeric base strip attached to and covering said exterior end;

c. a polymeric stop strip mounted adjacent said inner face and having first and second ends, said first end interfitted with said base strip, and said second end attached to said support panel and having a stop face formed thereon extending outwardly from said inner face; and d. wherein said base strip and said stop strip are separately formed, distinct pieces.

26. The door frame assembly of claim 25 wherein a portion of said inner face of said support panel adjacent said interior end is exposed for mounting a hinge member directly thereto.

27. The door frame assembly of claim 25 wherein said base strip includes a decorative body portion extending forwardly from said exterior end of said support panel in a direction defined along the line between said interior and exterior ends of said support panel and a pair of spaced apart opposed side fins integrally formed with and extending from said body portion, said body portion and said side fins together defining a U-shaped channel, each of said side fins being secured to and disposed adjacent a respective one of said inner and outer faces of said support panel.

28. The door frame assembly of claim 25 wherein said base strip includes a connector tube formed therein sized and configured to receive a key whereby said door frame assembly may be joined to another door frame assembly to form a door frame system, said connector tube in cross-section being fully enclosed.

29. The door frame assembly of claim 25 wherein said base strip includes a J-shaped channel extending therefrom, said first end of said stop strip being interlocked with said J-shaped channel.

30. The door frame assembly of claim 25 wherein said stop strip includes a weatherstrip channel formed in said second end adjacent said stop face, said weatherstrip channel arranged and configured to receive and hold a weatherstrip.

31. The door frame assembly of claim 25 further including an extension strip disposed adjacent said inner face of said support panel and having a first end and a second end, said first end of said extension strip interfitted with said second end of said stop strip, said extension strip including a wall spaced from said inner face and defining therewith an opening adjacent said second end of said extension strip for receiving a garage door molding.

32. The door frame assembly of claim 25 further including a brick molding strip having a first end and a second end, said first end attached to said base strip.

33. The door frame assembly of claim 32 further including a brick molding nailing fin extending from said second end of said brick molding strip for securing said brick molding strip to a wall.

34. The door frame assembly of claim 32 wherein said base strip includes a base strip nailing fin and said brick molding strip substantially covers said base strip nailing fin.

35. The door frame assembly of claim 25 wherein said stop strip includes a body portion having a length extending between said first and second ends of said stop strip and further including a brace fin extending from and transversely to said length of said body portion and positioned between said first and second ends such that said brace fin extends toward said inner face of said support panel, said brace fin operative to limit deflection of said body portion toward said inner face.

36. The door frame assembly of claim 25 further including a fastener fin extending rearwardly from said stop face and operative to receive a fastener for securing said stop strip to said inner face of said support panel such that the fastener extends through said fastener fin and into said inner face of said support panel.

37. A stop strip for use with a base strip of the type having a connecting structure and a support panel having an inner face, said stop strip separately formed and distinct from the base strip and having first and second ends, said stop strip comprising:

a. a second connecting structure formed in said first end for connecting said stop strip to said base strip connecting structure;

b. a body portion having a length extending between said first and second ends, said body portion spaced apart from the inner face of the support panel when said stop strip is mounted on the support panel;

c. a stop face formed in said second end of said stop strip; and d. a weatherstrip channel formed in said stop face, said weatherstrip channel arranged and configured to receive and hold a weatherstrip.

38. The stop strip of claim 37 wherein said second connecting structure includes a groove formed in said body portion between said first and second ends of said stop strip and adapted to engage and retain said connecting structure of the base strip.

39. The stop strip of claim 37 further including a brace fin extending from and transversely to said length of said body portion and positioned between said first and second ends such that said brace fin extends toward the inner face of the support panel when said stop strip is mounted on the support panel, said brace fin operative to limit deflection of said body portion toward the inner face.

40. The stop strip of claim 37 further including a fastener fin extending rearwardly from said stop face and operative to receive a fastener for securing said stop strip to the inner face of the support panel such that the fastener extends through said fastener fin and into the inner face of the support panel.

* * * * *